United States Patent [19]

Forbes

[11] 3,938,617

[45] Feb. 17, 1976

[54] SPEAKER ENCLOSURE

[75] Inventor: Lonnie R. Forbes, Albuquerque, N. Mex.

[73] Assignee: Fort Enterprises, Limited, Albuquerque, N. Mex.

[22] Filed: Feb. 7, 1975

[21] Appl. No.: 546,315

Related U.S. Application Data

[63] Continuation-in-part of Ser. No. 434,188, Jan. 17, 1974, abandoned.

[52] U.S. Cl. ..... 181/155; 181/148

[51] Int. Cl.[2] ..... G10K 13/00; H04R 1/28

[58] Field of Search ..... 181/155, 160, 148

[56] References Cited

UNITED STATES PATENTS

| | | | |
|---|---|---|---|
| 2,891,629 | 6/1959 | Mercurius | 181/145 |
| 2,917,127 | 12/1959 | Elliott | 181/151 |
| 3,143,182 | 8/1964 | Sears et al. | 181/153 |
| 3,239,028 | 3/1966 | Murray | 181/154 |
| 3,371,742 | 3/1968 | Norton et al. | 181/153 |

*Primary Examiner*—Stephen J. Tomsky
*Attorney, Agent, or Firm*—William C. Babcock

[57] ABSTRACT

An acoustic speaker enclosure of sufficiently thin design that it may be suspended from a wall and then concealed by a framed picture being hung thereover. Forwardly directed sound from the speaker radiates transversely through 360° through a first passage defined in the enclosure. Rearwardly directed sound from the speaker is transmitted to the resonator frame through a second free transverse passage as well as a baffled third passage. A rearwardly disposed resonance board of the speaker enclosure is in abutting contact with the wall, and rearwardly sound from the enclosure is transmitted through this resonance board to the wall to resonate the latter to radiate sound to the room in which the speaker enclosure is disposed. Due to the multiplicity of sources of sound from the acoustic disclosure, a hearer in a room is not cognisant of the location thereof, particularly when the enclosure is concealed by a framed picture. The speaker enclosure if desired may be modified to provide a desk or table supported unit.

7 Claims, 9 Drawing Figures

FIG. 1
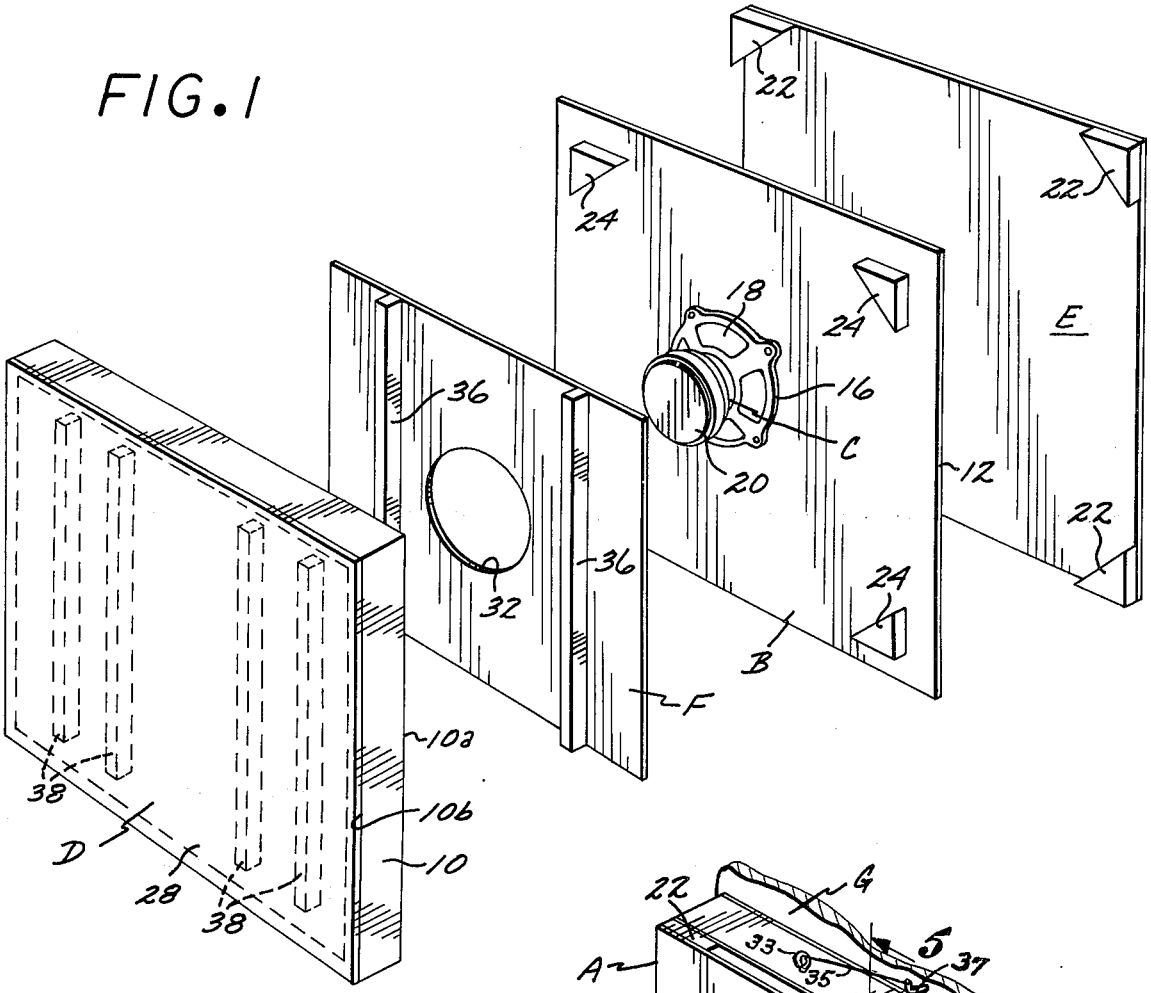
FIG. 3
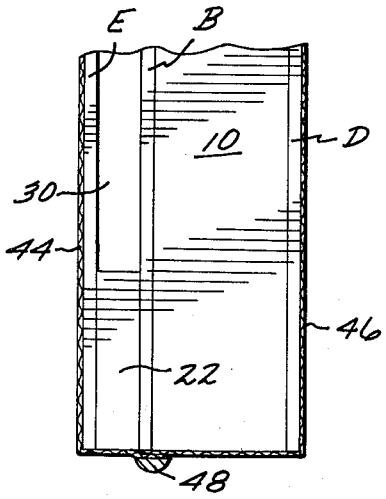
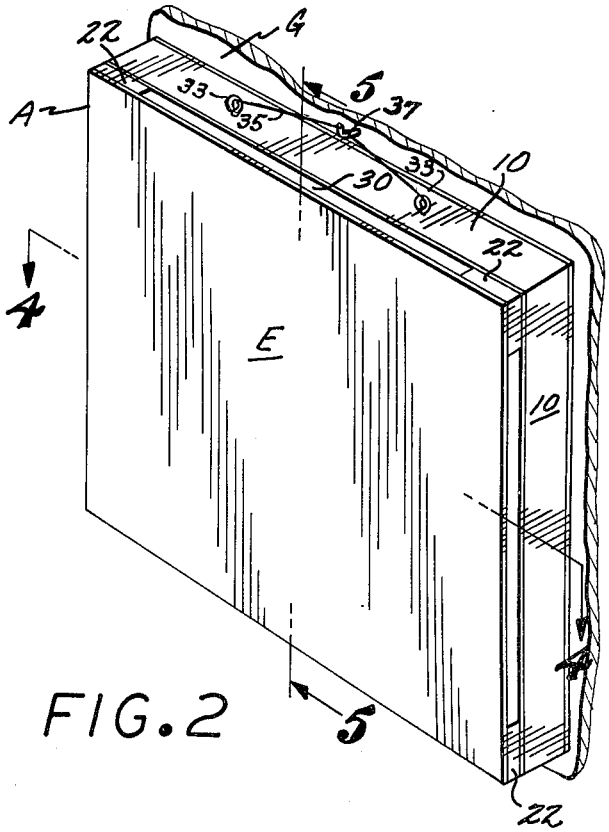
FIG. 2

FIG. 4
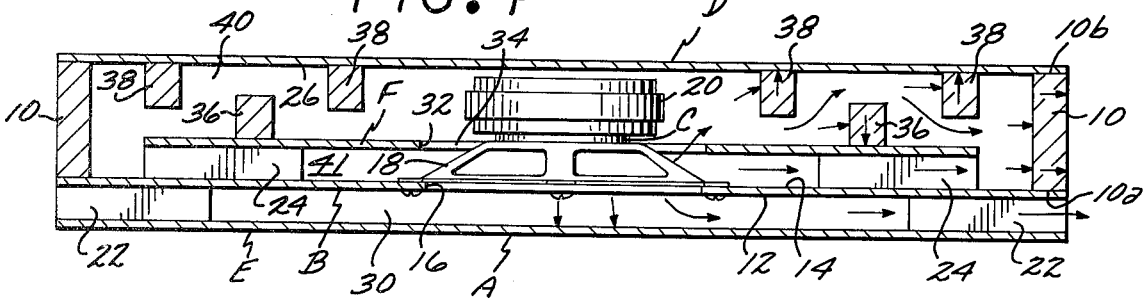
FIG. 5
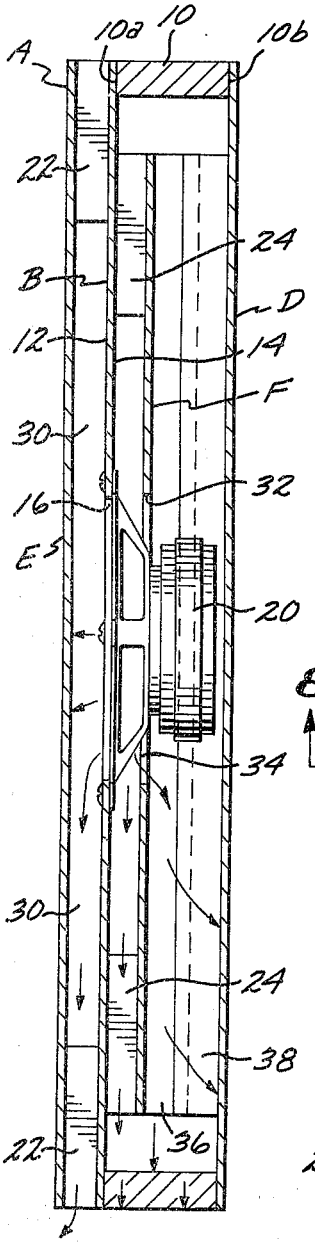
FIG. 6
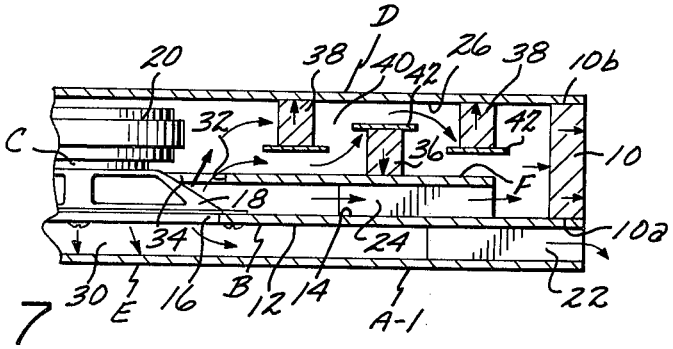
FIG. 7
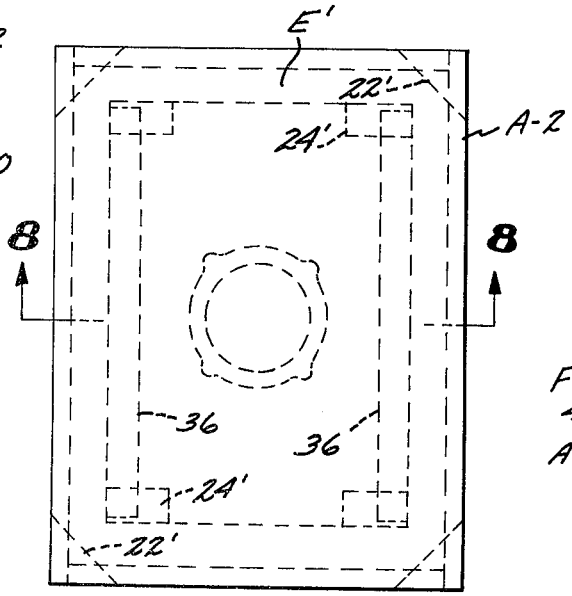
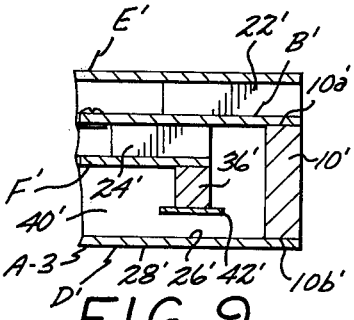
FIG. 9
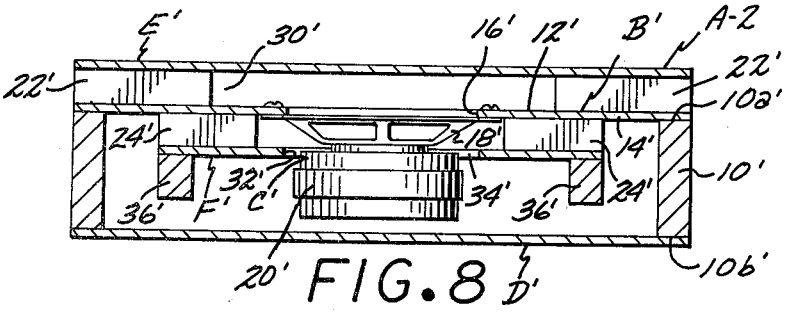
FIG. 8

SPEAKER ENCLOSURE

CROSS-REFERENCE TO RELATED APPLICATIONS

The present application is a continuation-in-part of an application Ser. No. 434,188, filed Jan. 17, 1974, by LONNIE R. FORBES entitled SPEAKER ENCLOSURE, now abandoned.

BACKGROUND OF THE INVENTION

1. Field of the Invention

This invention relates to an acoustic speaker enclosure for audio speakers that is particularly adapted to being formed in a sufficiently thin design as to be suspended from a wall and have a framed picture hung therof to conceal the same. The acoustic speaker enclosure may be modified to provide a desk or table supported unit.

2. Description of the Prior Art

In the past numerous acoustic speaker enclosures have been developed and used with audio speakers, but these prior art devices have the operational disadvantages that they are bulky in appearance and cannot be readily concealed in the room in which they are disposed.

A major object of the present invention is to provide an acoustic speaker enclosure of sufficiently thin design as to be suspended from a wall and concealed by a framed picture that is hung thereover.

Another object of the invention is to supply an acoustic speaker in which forwardly directed sound emanates radially from the entire periphery thereof, and rearwardly directed sound is transmitted to the supporting wall to resonate the same, and the rearwardly directed sound also being transmitted to the resonator frame of the enclosure through both a free second transverse passage and abaffed third passage.

Another object of the invention is to furnish an acoustic speaker enclosure that utilizes the wall from which it is suspended as a resonator, as well as directing sound generated by the acoustic speaker from a multiplicity of sources defined by the enclosure, and as a result a hearer not having the impression that the sound is emanating from a localized source.

SUMMARY OF THE INVENTION

The acoustic loud speaker enclosure in a preferred form is sufficiently thin as to be suspended in abutting contact with a wall and concealed behind a framed picture hung from the wall.

The enclosure includes a multi-sided resonator frame that has marginal side portions of forwardly and rearwardly disposed resonance boards secured to the peripheral edge surfaces thereof, and the frame and forward and rearward resonance boards cooperating to define an enclosed volume. The forward resonance board has a centered first aperture that is sized for mounting a large end of an acoustic speaker therein.

Groups of spaced first and second blocks are rigidly secured to the forward and rearward surfaces of the forward resonance board, with the first blocks supporting a coverboard forwardly of the forward resonance board, and the second blocks supporting a baffle sheet intermediately between the forward and rearward resonance boards. The baffle sheet has a second aperture therein through which the magnet end of the acoustic speaker extends. The magnet end and second aperture cooperate to define an annulus space. A number of spaced first and second elongate baffles are rigidly secured to the adjacent surfaces of the baffle and second resonance board.

Forwardly directed sound from the acoustic speaker travels transversely in all directions through a first passage defined between the coverboard and first resonance board. Rearwardly directed sound from the acoustic speaker travels freely through a second transverse passage formed between the first resonance board and baffle to the resonator frame. Also, rearwardly directed sound from the acoustic speaker also travels transversely through a labyrinth to the resonator frame. The labyrinth is defined by the spaced baffles, the rearward surface of the baffle sheet, and the forward surface of the rearward resonance board. Rearwardly directed sound also is transmitted to the wall through the rearward resonance board, with the wall resonating as a result thereof.

An acoustic speaker enclosure suitable for being supported on a desk or table may be provided by slightly modifying the preferred form of the invention.

BRIEF DESCRIPTION OF THE DRAWINGS

FIG. 1 is an exploded perspective view of a first form of the acoustic loud speaker enclosure;

FIG. 2 is a perspective view of the first form of the device supported from a wall;

FIG. 3 is a fragmentary transverse cross-sectional view of the device;

FIG. 4 is a transverse cross-sectional view of the device taken on the line 4—4 of FIG. 2;

FIG. 5 is a second transverse cross-sectional view of the device taken on the line 5—5 of FIG. 2;

FIG. 6 is a transverse cross-sectional view of a second form of the device;

FIG. 7 is a front elevational view of a third form of acoustic loud speaker enclosure that may be supported on a desk or table;

FIG. 8 is a transverse cross-sectional view of the third form of the device taken on the line 8—8 of FIG. 7; and FIG. 9 is a transverse cross-sectional view of a fourth form of the device.

DESCRIPTION OF THE PREFERRED EMBODIMENTS

The first form A of the loud speaker acoustic enclosure that is adapted to be supported in a fixed position on a wall G and concealed by a framed picture (not shown) is illustrated in FIGS. 1 to 5 of the drawings.

First form A includes a multi-sided frame 10 that is illustrated as being substantially square in shape, and is preferably formed from a hard wood such as Philippine mahogany, or the like. The frame 10, as shown in FIG. 1, has a forward peripheral edge 10*a* and rear peripheral edge 10*b*.

A forward resonance board B is provided that is formed from a hard sheet material, commonly referred to as hard board, of which MASONITE is an example. The forward resonance board B has a forward side surface 12 and rear side surface 14. The forward resonance board B has a first centered aperture 16 therein that is sized to have a large end 18 of an electrical speaker C mounted therein by conventional means. Electrical speaker C is of conventional design currently available in the commercial market and includes a magnet end 20 of generally cylindrical configuration.

A number of first blocks 22 are provided that are preferably formed from a hard wood and are illustrated in FIG. 1 as being triangular and of substantial thickness. A number of second blocks 24 are also provided that are illustrated in FIG. 1 as of the same shape as the first blocks and also formed from a hard wood.

The first form A of the enclosure also includes a rear resonance board D that is illustrated as being of substantially the same size and shape of the forward resonance board B. Rear resonance board D has a forward side surface 26 and rear side surface 28. First form A of the enclosure includes a cover board E that is illustrated as being substantially the same size and shape as forward resonance board B. The first blocks 22, as may be seen in FIG. 1, are bonded by conventional means to the rear corner side surfaces of cover board E. Cover board E is preferably formed from a hard sheet material such as MASONITE that is commonly referred to commercially as hard board. In FIGS. 2 and 3 it will be seen that the rear surfaces of first blocks 22 are bonded to the corner portions of the forward surface 12 to support the cover board in forwardly spaced relationship to forward resonance board B. The cover board E and forward resonance board B cooperate to define a transverse passage 30 therebetween as shown in FIGS. 4 and 5 through which forwardly directed sound from electrical speaker C travels to radiate radially from the enclosure into the room in which the latter is disposed.

A baffle sheet F is also provided as a part of the first form A of the enclosure, and is also formed from hard board. Baffle board F is of substantially less transverse area than the forward and rear resonance boards B and D between which it is intermediately disposed. Baffle sheet F has a second centered aperture 32 formed therein through which the magnet end 20 of speaker C extends. The second aperture is of sufficient transverse area that it cooperates with magnet end 20 to define an annulus space 34 therebetween.

The forward surface of baffle sheet F at the corners thereof is bonded to the rear surfaces of second blocks 24. The rear surface 14 of forward resonance board B at the corner portions thereof is bonded to the forward edge surfaces 10*a* of resonator frame 10. The frame 10, forward resonance board B and rear resonance board cooperatively define an interior enclosure in which the baffle sheet F is disposed.

A pair of elongate first baffles 36 are illustrated in the drawings as being bonded to the rear surface of baffle sheet F on opposite sides of second aperture 32, and these baffles being generally rectangular in transverse cross-section. On the forward surface of the rear resonance board D a number of second elongate baffles are secured, out of alignment with first baffles 36 but parallel thereto.

The first and second baffles 36 and 38 are of sufficient depth that in cooperation with baffle sheet F and rear resonance board D a labyrinth 40 is provided. In FIG. 4 it will be seen that a portion of rearwardly directed sound from electrical speaker C may travel freely through a second transverse passage 41 directly to all portions of resonator frame 10. A portion of rearwardly directed sound from electrical speaker C will travel through annulus space 34 and then transversely through labyrinth 40 to the resonator frame 10. Also, a portion of the rearwardly directed sound from the electrical speaker C will travel through rear resonance board D to wall G to resonate the latter. The rear resonance board D is preferably in abutting contact with the adjacent surface of wall G.

Transversely sapced eyes 33 are provided on the upper portion of frame 10 between which a cord 35 extends, and the cord is engaged at substantially the center thereof by a hook 37 or other support affixed to wall G. The first form A of the enclosure when so supported has the rear resonance board D in abutting contact with wall G.

The paths of forward and rearwardly directed sound from the electrical speaker C through the first form A of -the enclosure is illustrated by arrows in FIG. 4.

From the above description it will be seen that sound generated by actuation of the electrical speaker C travels to the room in which the first form A of the speaker is disposed from a number of different sources. Forwardly directed sound from speaker C radiates radially in all directions from the enclosure through the first transverse passage 30. Rearwardly directed sound in part travels through the second transverse passage 41 to frame 10 to resonate the latter. A second portion of the rearwardly directed sound travels through labyrinth 40 to the frame 10. By varying the resistance of sound travel through labyrinth 40 which is accomplished by the number and spacing of baffles 36 and 38. The low notes produced by electrical speaker C may be emphasized or de-emphasized. Also, a portion of the rearwardly directed sound from speaker C travels through rear resonance board D to wall G to resonate the latter. Due to the multiplicity of sources from which sound emanates from the first form A of the enclosure, a hearer in a room in which the enclosure is disposed has no sensation of the sound coming from a localized source. When the first form A of the enclosure is concealed behind a framed picture it is even more difficult for a hearer to pinpoint the source from whence the sound originates.

A second form A-1 of the acoustic speaker enclosure is shown in FIG. 6 that is identical to the first form A, other than that baffle strips 42 are secured to the adjacent free ends of at least a portion of the first and second baffles 36 and 38 to increase the resistance to sound traveling through labyrinth 40. By use of baffle strips 42 it is possible to lower the low notes radiated by the second form A-1 of the enclosure by at least an octave.

A third form A-2 of the enclosure is shown in FIGS. 7 and 8 that is particularly adapted for being supported on a desk or table (not shown). The third form A-2 is identical to the first form A, other than in the third form the second baffles 38 are omitted. Elements in third form A-2 common to first form A are identified in FIGS. 7 and 8 by the same letters and numerals previously used on first form A, but to which primes have been added. The third form A-2 is of sufficient thickness as to remain in an upright position when supported on a desk or table (not shown).

The fourth form A-3 of the enclosure shown in FIG. 9 is identical to third form A-2, other than the fourth form, includes baffle strips 42′ secured to the free rear edge surfaces of first baffles 36. The baffle strips 42 and 42′ are of greater width than the baffles 36, 38 and 36′, from which they are supported. Although the frame 10 has been referred to as multi-sided it will be apparent that it could be circular if desired, and multi-sided as used herein is considered to include a circle or other curved geometrical configuration.

In FIG. 3 it will be seen that a sheet 44 of felt or like material may be extended over the forward surface of the cover board E and then rearwardly to span the first transverse passage 30. The rearward portion of the first form A if the enclosure may be wholly or partially enveloped by a sheet 46 of plastic that extends forwardly over frame 10 towards sheet 44. The junction line of the sheets 44 and 46 is concealed by an opaque strip 48 that is secured to the enclosure by conventional means.

The use and operation of the various forms of the invention have been described previously in detail and need not be repeated.

I claim:

1. A loud speaker acoustic enclosure sufficiently thin as to be supported from a vertical wall and concealed by a wall mounted picture disposed forwardly thereof, said acoustic enclosure including:

a. a multi-sided resonator frame having forward and rearward edges;

b. forward and rearward resonance boards bonded to said forward and rearward edges of said frame to cooperate with the latter to define an enclosed volume, said forward resonance board having a first aperture therein that is sized for mounting a large diameter end of an electrical speaker therein, said forward and rearward resonance boards each having forward and rearward surfaces;

c. a plurality of spaced first and second blocks secured to said forward and rearward surfaces of said forward resonance board adjacent said frame;

d. a cover board rigidly secured to said first blocks and disposed forwardly of said forward resonance board and cooperating with the latter to define a transversely extending first passage;

e. a baffle sheet of smaller transverse area than the interior of said frame that is transversely spaced from the latter and disposed in said enclosed volume, said baffle sheet supported from said second blocks parallel to said forward and rearward resonance boards, said baffle sheet having a second aperture therein through which the magnet end of the electrical speaker may extend, said magnet end and second aperture defining an annulus space therebetween said baffle sheet having forward and rearward surfaces;

f. a plurality of elongate spaced first baffles secured to said rearward surface of said baffle sheet and on opposite sides of said second aperture, with forwardly directed sound from said speaker travelling transversely through said first passage to emanate radially from all sides thereof, and rearwardly directed sound from said speaker to said resonator frame both through a second transverse passage defined between said rearward surface of said forward resonance board and forward surface of said baffle sheet as well as through said annulus and a transverse labyrinth defined by said first baffles, said forward surface of said rear resonance board and said rearward surface of said baffle sheet, and rearwardly directed sound also traveling through said rearward resonance board to said wall to resonate the latter; and g. means for supporting said enclosure from said wall with said rearward resonance board in abutting contact with the latter.

2. A loud speaker acoustic enclosure as defined in claim 1 which in addition includes:

a. a plurality of first baffle strips of greater width than said first baffles secured transversely to rearward surfaces of said first baffles in longitudinally extending positions thereon to increase the resistance of sound in traveling through said labyrinth.

3. A loud speaker acoustic enclosure as defined in claim 1 which in addition includes:

a. a plurality of second baffles secured to said forward surface of said rear resonance board out of transverse alignment with said first baffles but parallel thereto, said second baffles cooperating with said first baffles to increase the resistance to sound in traveling transversely through said labyrinth.

4. A loud speaker acoustic enclosure as defined in claim 1 which in addition includes:

a. a plurality of second baffle strips of greater width than said second baffles secured transversely to forward surfaces of said second baffles in longitudinally extending positions thereon to further increase the resistance of sound in travelling through said labyrinth.

5. A loud speaker acoustic enclosure suitable for being supported on a desk or table, said acoustic enclosure including:

a. a generally square resonator frame of sufficient width as to remain in an upright position when resting on a desk or table;

b. forward and rearward resonance boards bonded to said forward and rearward edges of said frame to cooperate with the latter to define an enclosed volume, said forward resonance board having a first aperture therein that is sized for mounting a large diameter end of an electrical speaker therein, said forward and rearward resonance boards each having forward and rearward surfaces;

c. a plurality of spaced first and second blocks secured to said forward and rearward surfaces of said forward resonance board adjacent said frame;

d. a cover board rigidly secured to said first blocks and disposed forwardly of said forward resonance board and cooperating with the latter to define a transversely extending first passage;

e. a baffle sheet of smaller transverse area than the interior of said frame that is transversely spaced from the latter and disposed in said enclosed volume, said baffle sheet supported from said second blocks parallel to said forward and rearward resonance boards, said baffle sheet having a second aperture therein through which the magnet end of the electrical speaker may extend, said magnet end and second aperture defining an annulus space therebetween said baffle sheet having forward and rearward surfaces; and f. a plurality of elongate spaced first baffles secured to said rearward surfaces of said baffle sheet and on opposite sides of said second aperture, with forwardly directed sound from said speaker traveling transversely through said first passage to emanate radially therefrom, and rearwardly directed sound from said speaker to said resonator frame both through a second transverse passage defined between said first resonance baord and said baffle sheet, as well as through said annulus and a transverse labyrinth defined by said first baffles and said baffle sheet and rear resonance board.

6. A loud speaker enclosure as defined in claim 1 which in addition includes:

a. a sheet of opaque sound transmitting material that extends ovey the forward surface of said cover board and rearwardly over said frame to the extent that said first passage is concealed.

7. A loud speaker enclosure as defined in claim 5 which in addition includes:

a. a sheet of opaque sound transmitting material that extends over the forward surface of said cover board and rearwardly over said frame to the extent that said first passage is concealed.

* * * * *